US007264766B2

(12) United States Patent
McDaniel

(10) Patent No.: US 7,264,766 B2
(45) Date of Patent: Sep. 4, 2007

(54) FEED APPARATUS AND PORTABLE DUST COLLECTOR

(76) Inventor: David M. McDaniel, 1425 12th Ter., Pleasant Grove, AL (US) 35127

( * ) Notice: Subject to any disclaimer, the term of this patent is extended or adjusted under 35 U.S.C. 154(b) by 534 days.

(21) Appl. No.: 10/952,401

(22) Filed: Sep. 28, 2004

(65) Prior Publication Data

US 2006/0066014 A1 Mar. 30, 2006

(51) Int. Cl.
*C21C 7/00* (2006.01)

(52) U.S. Cl. ..... 266/216; 266/242

(58) Field of Classification Search ..... 266/216, 266/242; 373/151, 153
See application file for complete search history.

(56) References Cited

U.S. PATENT DOCUMENTS 1,971,195 A * 8/1934 McKibben ..... 373/141
3,916,047 A * 10/1975 Niesen ..... 428/34.1
3,948,644 A 4/1976 Maurice et al.
4,789,506 A * 12/1988 Kasprzyk ..... 264/431
5,058,776 A 10/1991 Courtney et al.
2003/0015812 A1 1/2003 Opatt et al.

* cited by examiner

*Primary Examiner*—Len Tran
(74) *Attorney, Agent, or Firm*—Robert M. Poteat, PC; Robert M. Poteat

(57) ABSTRACT

A feed apparatus feed apparatus for delivering particulate material to a foundry furnace having disposed therein a furnace form defining an annulus with the furnace exterior wall for receipt of the particulate material. The novel feed apparatus broadly includes a cover, having a top end, side wall, and a bottom end, the latter of which is adapted to fit on top of the furnace ring or melt deck floor; a rotatable tabletop that is adapted to fit on the top end of the cover while permitting air ingress into the cover and having at least one access port for delivering the particulate material into the interior of the cover; a form top that is adapted to fit within the cover on top of the furnace form to facilitate delivery of said particulate material into the annulus made by the furnace form and the furnace exterior wall; means for rotating the tabletop about the centerline of the cover; and means for centering the tabletop as it rotates about the centerline of the cover.

25 Claims, 8 Drawing Sheets

FEED APPARATUS AND PORTABLE DUST COLLECTOR

CROSS REFERENCE TO RELATED APPLICATIONS

Not Applicable

BACKGROUND OF THE INVENTION

1. Field of Invention

The present invention relates to an apparatus for feeding or loading fine particulate material into industrial plant equipment and to a portable dust collector for filtering and removing of dust and particulate materials that are generated in industrial plants, such as foundry furnaces. The present invention more particularly relates to an apparatus for feeding and loading fine particulate material, such as fine silica powder, into foundry furnaces and to a portable dust collector for removing such dust and fine particulate materials during relining operations of foundry furnaces.

2. Description of the Related Art

Generation of dust and fine particulate materials, e.g., fine silica powder, in industrial plants is a particular vexing and serious health problem. The U.S. Department of Labor's Occupational Safety and Health Administration (OSHA) has established regulations that set forth safety guidelines and industrial standards that are required to be met owners in the operation of industrial plants for the protection of employee's health and safety. For example, OSHA has established guidelines in the U.S. metal-casting industry, which includes foundry furnace industry, for exposure to silica in the workplace and includes a maximum exposure limit of 20 parts per million (ppm) for crystalline silica in an 8-hour day.

Recently, attesting to the significance of silica as a workforce safety hazard, the America Foundry Society (AFS) and OSHA the signed a two year new alliance agreement to continue joint efforts to promote safer and more healthful workplaces in the U.S. metal-casting industry that will help AFS members protect employee's health and safety, particularly focusing on workplace issues, including personal protective equipment, ventilation and reducing and preventing exposure to silica.

Exposure to silica particulates is especially seen as hazardous in the foundry industry, such as the coreless induction furnaces, which require frequent installing of the refractory (e.g., silica) liners. Heretofore, the fine silica powder was delivered in bags, which were then opened by workers by slitting the bag and dumping the fine silica powder into the annulus formed by a sacrificial metal liner (furnace form) and the furnace exterior wall. This technique is quite dirty and generates large amounts of very fine silica powder and dust particulates that float around in the air and may create health problems for the workers. Typically, foundry furnace operators pull a vacuum over the furnace freeboard above the open reactor vessel to reduce the level of silica powder and dust particulates exposure to their workers. Workers also typically wear personal protective equipment, including respirators, masks, etc., to attempt to filter out the fine silica powder and dust particulates but the silica powder and dust particulates are so pervasive that they continue to present health hazards due to ingestion of fine silica powder and dust particulates, which can lead to silicosis an incurable lung disease.

Other more conventional feed devices include one, for example, described in U.S. Pat. No. 2003/0015812 A1, which involves a method for installing a refractory lining in coreless or channel electric induction furnaces by adding dry refractory material between a liner form and an inner wall of the furnace. There, a simple funnel is used for placement of the refractory material in a coreless electric furnace. While the use of a funnel is possibly beneficial in better directing the dry refractory material into the annulus formed by the liner form and the inner wall of the furnace, it obviously generates dust and fine particulate material into the atmosphere surrounding the furnace, which creates a hazardous condition for the foundry workers installing the refractory liners.

Another feed apparatus for loading particulate material into foundry furnaces, such as cylindrical coreless electric furnaces, is described in U.S. Pat. No. 5,058,776. This patent discloses an apparatus for dispensing particulate material for foundry furnaces into an annulus formed by the furnace wall and an expendable cylindrical form. In particular there is provided a cylindrical platform covering the top of the expendable metal form and adapted to rotate around the center line axis of the metal form by a carriage rotatably mounted on the platform and riding on wheels that travel along a circular track that is inboard and concentric with the annulus formed between the furnace wall and the metal expendable form. The cylindrical platform includes a circular rim that fits about the open top of the expendable liner to position the apparatus. A hopper is carried on the top of the cylindrical platform having an opening in the lower end for discharging the particulate material into the annulus. A motor is also provided for rotating the cylindrical platform around the top of the cylindrical metal form. While this apparatus provides a delivery system for particulate material into foundry furnaces, such as coreless electric furnaces, it is expensive and complex to operate.

As noted above, these prior art feed apparatuses and designs provide little or no protection for workers who are dispensing the particulate material in foundry furnaces, such as a coreless electric furnace. Viewing U.S. Pat. No. 5,058,776, above, there is noted that the feed dispensing apparatus disclosed therein is open to the atmosphere and any particulate dust would be carried into the atmosphere that surrounds the operator and like conventional prior art apparatuses, e.g., funnels, provide no reduction of the particulate dust formed in the furnace re-lining operation. Thus, while these prior art devices address apparatuses for the introduction of particulate material into foundry furnaces during the re-lining operation, they offer little or no abatement of the generated dust or fine particulate material, such as fine silica powder, during the critical furnace re-lining operation which depending on the size and through-put (as measured in tons) of metal must be repeated every 2-4 weeks.

Thus, it may be seen that there is a need to provide a simple, less costly feed apparatus for use in delivering particulate materials, such as fine silica powders, into foundry furnaces, e.g., coreless electric furnaces. There also is a need to provide a cost effective and efficient dust collector for use in removing fine dust and particulate materials (e.g., fine silica powders) in foundry operations, such as in re-lining operations of coreless electric furnaces.

BRIEF SUMMARY OF THE INVENTION

In view of the above needs, it is a primary objective of the present invention to provide a simple and efficient feed apparatus for feeding or loading fine particulate material into industrial plant equipment, such as coreless electric furnaces.

Another objective of the invention is to provide a cost-effective and efficient portable dust collector for filtering and removing of dust and particulate materials that are generated in industrial plants, such as coreless electric furnaces.

Other and further objects of the present invention will become apparent to those skilled in the art from a reading of the following detailed description of the invention together with the appended claims and by reference to the accompanying drawings.

In one aspect of the invention there is provided a feed apparatus for delivering particulate material to a foundry furnace having disposed therein a furnace form defining an annulus with the furnace exterior wall for receipt of the particulate material. The novel feed apparatus broadly includes a cover, having a top end, side wall, and a bottom end, the latter of which is adapted to fit on top of the furnace ring or melt deck floor; a rotatable tabletop that is adapted to fit on the top end of the cover while permitting air ingress into the cover and having at least one access port for delivering the particulate material into the interior of the cover; a form top that is adapted to fit within the cover on top of the furnace form to facilitate delivery of said particulate material into the annulus made by the furnace form and the furnace exterior wall; means for rotating the tabletop about the centerline of the cover; and means for centering the tabletop as it rotates about the centerline of the cover.

In another aspect of the present invention there is provided a portable dust collector for filtering and removing of dust and particulate materials that are generated in industrial plants, such as coreless electric furnaces. The portable dust collector broadly includes a cover, having a top end, side wall, and a bottom end, the latter of which is adapted to fit on top of the furnace ring or melt deck floor; a rotatable tabletop that is adapted to fit on the top end of the cover while permitting air ingress into the cover and having at least one access port for delivering the particulate material into the interior of the cover; a form top that is adapted to fit within the cover on top of the furnace form to facilitate delivery of said particulate material into the annulus made by the furnace form and the furnace exterior wall; means for rotating the tabletop about the centerline of the cover; means for centering the tabletop as it rotates about the centerline of the cover; and means for filtering the dust and particulate materials that are generated within the cover during plant operations and collecting same for ultimate removal and disposition thereof.

These and other embodiments of the invention provide for a number of advantages over the prior art devices. First, the feed apparatus of the present invention is a simple and straightforward design for delivering particulate material, e.g., fine silica powder, to a foundry furnace, such as a coreless electric furnace, during re-lining operations. As may be seen from the drawings and detailed description of the invention, the particulate material may be introduced through an access port, such as either a spout or a centrally disposed access port located in the rotatable tabletop and allowed to fall onto a form top, which is of an inwardly tapered design that fits on top of the furnace form located within the cover to thereby direct the introduced particulate material into the annulus formed by the furnace form and the furnace exterior wall. Advantageously, in the design using the spout, the rotatable tabletop, which is easily rotated about the center line of the furnace, facilitates the uniform introduction of the particulate material into the annulus as the spout is continuously moved around the arc defined by the annulus with respect to the centerline of the furnace. As such, a continuous layer of the particulate material is delivered into the annulus which provides for a more uniform packing and density of the particulate material, resulting in less tamping of the particulate material.

Second, the design of the present invention provides a portable dust collector that achieves a marked reduction in airborne dust and fine particulate material, such as fine silica powder, over prior art devices, resulting in a safer, less hazardous work environment for foundry workers. In several tests, airborne silica dust and particulates were reduced in a range of from a low of about 60% and up to a high of about 80% (as determined by standard air sampling techniques) over the conventional approach of delivering the silica powder or particulate material via a slit-bag and pouring of the silica powder or particulate material into the annulus formed between the form liner and the exterior furnace wall. It is believed that no other prior art collection and/or filtration device achieves anywhere near these significant reductions in airborne dust and fine particulate material as has been demonstrated by the novel portable dust collector of the present invention. Thus, it is believed that the present invention will, during the process of re-lining a typical foundry furnace, such as a coreless induction electric furnace, enable the furnace operator closer to the OSHA limits for airborne crystalline silica and provide a safer workplace for its employees.

DETAILED DESCRIPTION OF THE INVENTION

Figure 1:
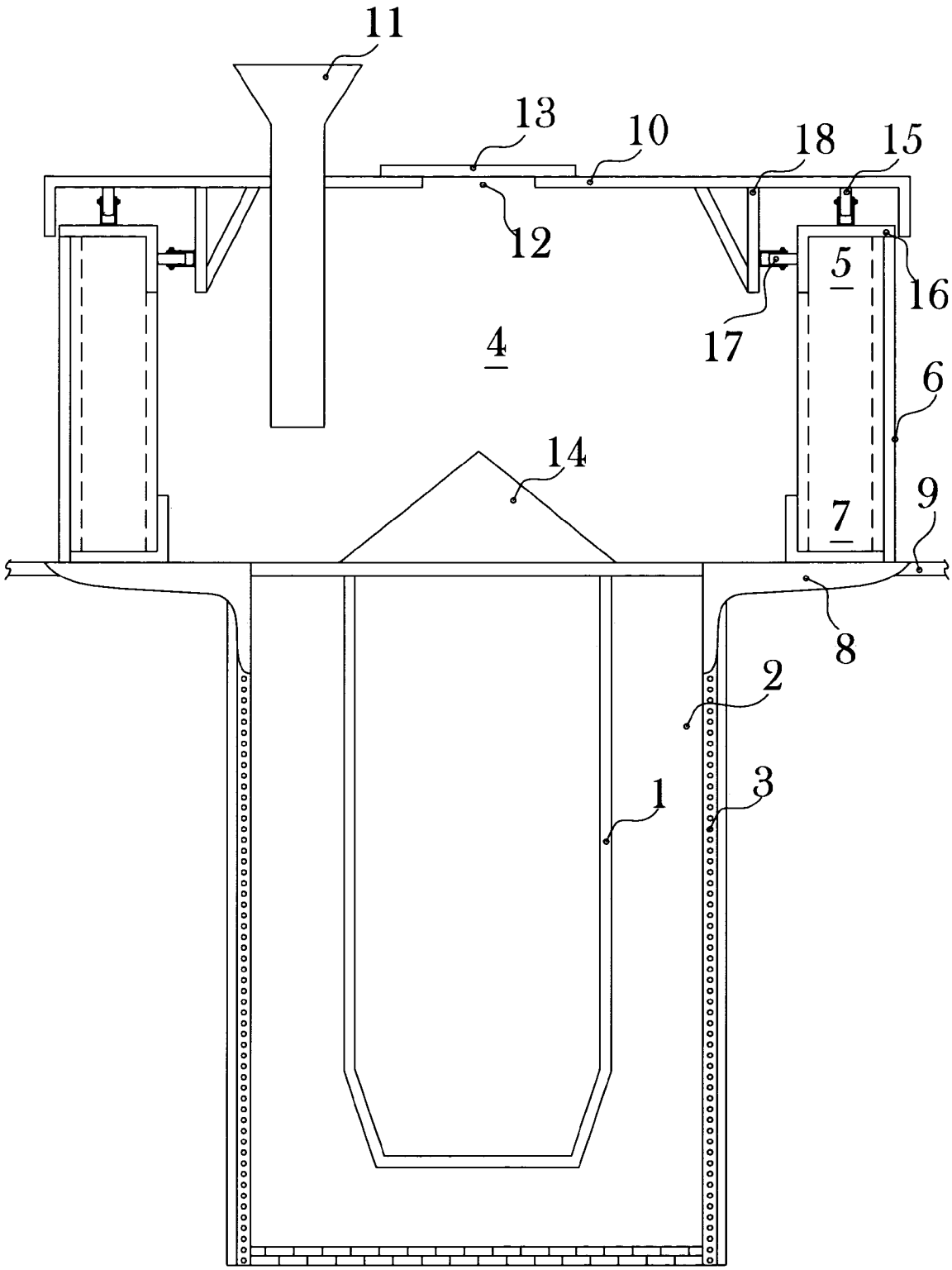
FIG. 1 is a schematic illustration of the feed apparatus of the present invention shown in position above a coreless electric induction furnace resting on the furnace ring. For purposes of illustration of the invention the dome of the furnace is not shown, as well as the pour spout of the furnace for removal of the molten metal from the furnace upon completion of the melting operation.

The present invention can best be described with reference to the attached drawings and photographs. The reference characters refer to the same parts throughout the various views. The drawings are not to scale and are presented to help illustrate the principles of the present invention in a clear manner. While the invention may be used in various foundry furnace applications (e.g., ABB Furnaces, Electric Melt Furnaces, Ajax Inducterthurm Furnaces, etc.), it will be illustrated in connection with a coreless electric furnace. This type of foundry furnace has an expendable metal furnace form that is disposed within the furnace that forms an annulus with the furnace exterior wall for receipt of said particulate material. The re-lining operation for furnaces of this type briefly includes removing the dome of the furnace and removing the old insulation liner (e.g., silica), which typically is removed by the use of a jackhammer or the use of a specially designed push rod to push the old hardened refractory insulation liner out of the furnace. After the old liner is completely removed from the furnace, a new expendable metal furnace form, such as a mild steel, is next inserted into position in the cavity of the furnace after an initial charge of the refractory lining material (e.g., silica powder) is poured (by hand) into the furnace along the bottom to a desired depth. The expendable metal form holds the silica material in place until the silica material is heated to an elevated temperature sufficient to harden or fuse the silica powder into a hardened refractory state to enable the silica material to remain in place as an insulating liner during the melting process; thus, protecting the exterior furnace wall. The furnace is now ready to have the feed apparatus of the present invention positioned over the top of the opened furnace with the bottom end of the cover resting or sitting on the furnace ring or melt deck floor.

In one embodiment of the present invention as shown schematically in FIG. 1, a feed apparatus of the present invention is shown for delivering particulate material, e.g., fine silica powder, to a coreless electric induction furnace having disposed therein a furnace form 1 defining an annulus 2 with the furnace exterior wall 3 for receipt of the particulate material. The novel feed apparatus broadly includes a cover 4, having a top end 5, side wall 6, and a bottom end 7, the latter of which is adapted to fit on top of the furnace ring 8 or melt deck floor 9; a rotatable tabletop 10 that is adapted to fit on the top end 5 of the cover 4 while permitting air ingress into the cover 4 and having at least one access port (two are shown for illustration: a material spout 11 and a central port 12 having a flange plate 13 for covering this central port when not in use) for delivering the particulate material into the interior of the cover 4; a form top 14 that is adapted to fit within the cover 4 on top of the furnace form 1 to facilitate delivery of said particulate material into the annulus 2 made by the furnace form 1 and the furnace exterior wall 3; means for rotating the tabletop 10 about the centerline of the cover 4 (shown for illustration as eight (8) spaced-apart casters 15, each of which has an overall height of approximately four inches with a three inch wheel and mounted on a lip 16 which is formed by a inside rolled angle iron that extends around the circumference of the top of the cover 4; and means for centering the tabletop 10 as it rotates about the centerline of the cover 4 (shown for illustration as eight (8) spaced-apart casters 17, each of which has an overall height of approximately four inches with a three inch wheel and each being mounted on a rolled angle iron 18 that may be welded, using gussets for holding the horizontal casters in place).

The feed apparatus of the preset invention may be constructed, as known by those in the foundry furnace art, of conventional structural materials, such as mild steel. For example, rotatable tabletop 10 may comprise a 3/16 inch mild steel checker plate rolled to a diameter, for example, of 68 inches. The side wall of cover 4 may be constructed out of 14 gauge mild steel plate. While the cover 4 may be any convenient height that will accommodate form top 14 it has been found that a height of about 24 inches is preferred. This height provides a convenient height for the foundry workers to easily lift the bags of silica powder for pouring into material spout 11 or where central port 12 is used to easily accommodate an overhead crane for positioning Supersacks of silica powder for delivery into the interior of the cover during the re-lining operation. The skeleton or framework to which the side wall is affixed may be constructed out of 2"×2" angle iron. The form top 14 may be constructed out of 26 gauge mild steel and formed into a cone shape having, for example, a 40 inch diameter at the bottom which will just fit over a typical coreless induction electric furnace that has a 39.5 inch ID expendable metal furnace form, thus, insuring that the silica powder is directed into the annulus. The spaced-apart casters are readily available as a commercial item.

Figure 5:
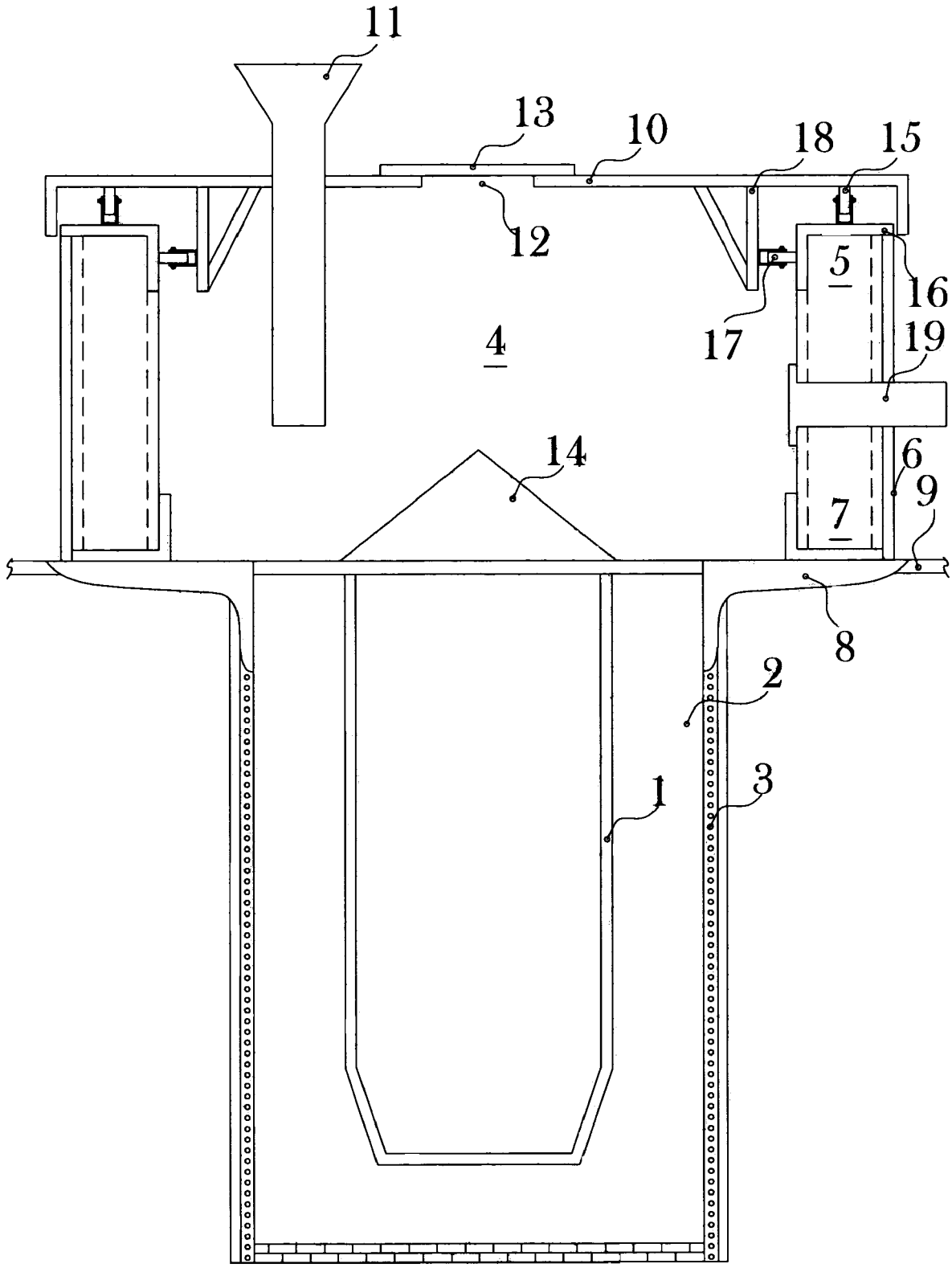
FIG. 5 is a schematic illustration of the portable dust collector of the present invention showing the feed apparatus depicted in FIG. 1 further including a vacuum and filtering system attached to the feed apparatus for filtering and removal of dust particle materials that are generated in a coreless induction electric furnace.

In another embodiment of the present invention, which is shown schematically in FIG. 5, there is provided a portable dust collector for filtering and removing dust and particulate materials that are generated during furnace re-lining operations of, for example, a coreless electric induction furnace. The portable dust collector may include a cover 4, having a top end 5, side wall 6, and a bottom end 7, the latter of which is adapted to fit on top of the furnace ring 8 or melt deck floor 9; a rotatable tabletop 10 that is adapted to fit on the top end 5 of cover 4 while permitting air ingress into cover 4 and having at least one access port (two are shown for illustration: a materials spout 11 and a central port 12 having a flange plate 13 for covering this central port when not in use) for delivering the particulate material into the interior of the cover 4; a form top 14 that is adapted to fit within the cover 4 on top of the furnace form 1 to facilitate delivery of said particulate material into annulus 2 made by the furnace form 1 and the furnace exterior wall 3; means for rotating the tabletop 10 about the centerline of the cover 4 (shown for illustration as eight (8) spaced-apart casters 15, each of which has an overall height of approximately four inches with a three inch wheel and mounted on lip 16 which is formed by an inside rolled angle iron that extends around the circumference of the top of cover 4; means for centering the tabletop 10 as it rotates about the centerline of cover 4 (shown for illustration as eight (8) spaced-apart casters 17, each of which has an overall height of approximately four inches with a three inch wheel and each being mounted on a rolled angle iron 18 that may be welded, using gussets for holding the horizontal casters in place).; and means (shown for illustration as a 4 inch outlet pipe 19 with flange for affixing the outlet pipe to sidewall 6 of cover 4 and being positioned from within cover 4 to make a leak tight fit with sidewall 6 and connected to a conventional vacuum system shown in FIGS. 11 and 12 ) for filtering the dust and particulate materials that are generated within the cover during plant operations and collecting same for ultimate removal and disposition thereof. The filtering means may include any commercially available vacuum and filtering systems. A particularly advantageous vacuum and filtering system is one that is commercially available from Dust Vent, Inc., located in Addison, Ill. This unit is shown in FIG. 12. Of particular advantage of this commercial unit are the design features of (1) an external crank that shakes the rows of filter media for removing the buildup of silica dust and particulate materials which are removed during the re-lining operations from the furnace and (2) a bottom located catch pan for collecting the filtered silica dust and particulate materials that are removed for ultimate disposing of the silica dust and particulate material from the furnace re-lining operations.

An additional feature of the present invention is the provision of wetting the silica dust and particulate material in the catch pan to further eliminated airborne silica dust and particulate material during disposal of the filtered materials. In this way, a small quantity of water may be added (for example by pouring the water into the catch pan) to turn the silica dust and particulate material into mud, thus, minimizing or eliminating airborne particles being released into the atmosphere.

It has been found, quite surprisingly, that the portable dust collector of the present invention can achieve such a marked reduction in airborne dust and particulate materials, such as fine silica particulates, generated in furnace re-lining operations. For example, in several tests airborne silica dust and particulates were reduced by greater than 60% (as determined by standard air sampling techniques) and as high as 80% over the conventional approach of delivering the silica powder or particulate material via a slit-bag and pouring of the silica powder or particulate material into the annulus formed between the furnace form liner and the exterior furnace wall. Such a marked reduction in airborne dust and particulate materials, may enable foundry operators during re-lining of, for example a coreless furnace, to better meet OSHA standards for silica of 20 ppm per 8-hour day, resulting in a safer, less hazardous work environment for foundry workers.

Figure 3:
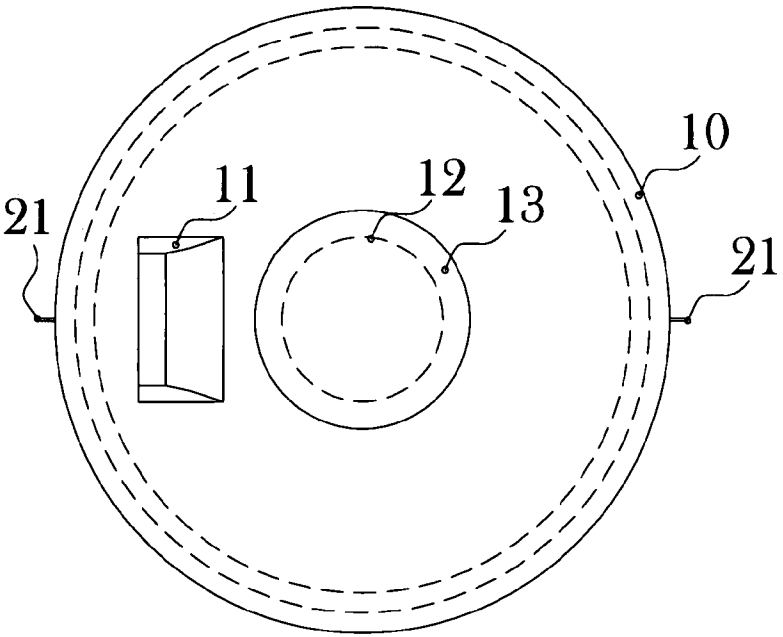
FIG. 3 is a top view of the tabletop showing both access ports.
Figure 2A:
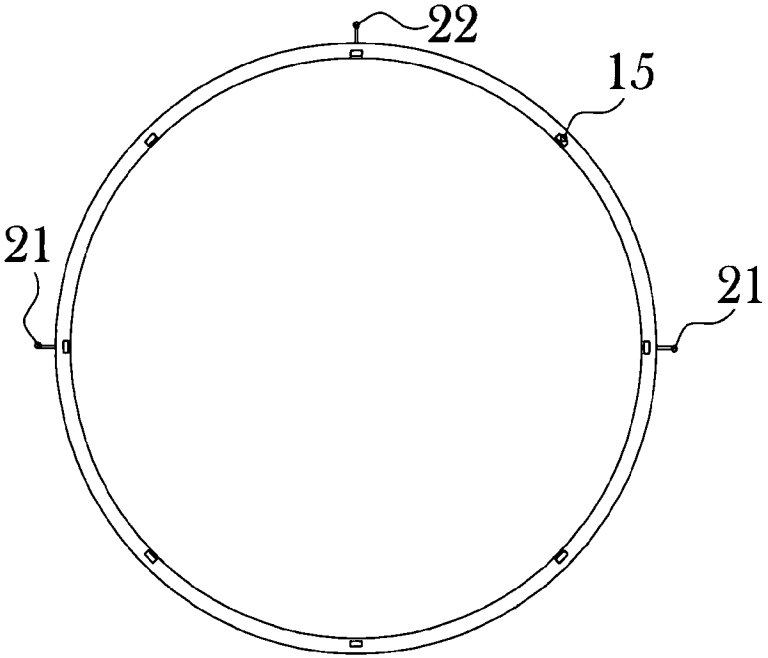
FIG. 2*a* is a top plan view that illustrates the tabletop (without the access ports shown) and the eight spaced-apart casters that provides the means for rotating the table top around the centerline of the cover.
Figure 2:
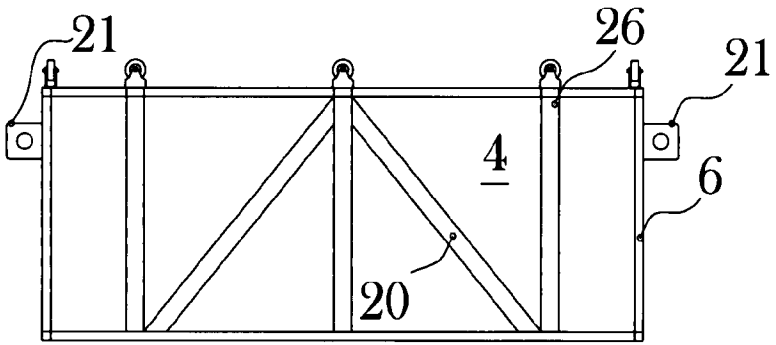
FIG. 2 is a side elevated view that illustrates the cover with the side wall removed and three of the spaced-apart casters mounted on a lip at the top of cover. There is also illustrated the skeleton or framework that supports the side wall of the cover.

Referring to FIGS. 2 and 2*a*, there is shown by way of illustration of the present invention, the skeleton or framework to which the side wall 6 is affixed to form cover 4. For this, the skeleton or framework may be constructed out of 2'×2' angle iron having vertical members 26 and diagonal members 20. External lifting eyes 21 are shown. FIG. 2*a* shows by way of illustration the eight spaced-apart casters 15 that provide the means for rotating tabletop 10 about cover 4. FIG. 3 shows by illustration a top view of tabletop 10 showing access ports, 11 and 12, flange plate 13 for covering the central port when not in use.

Figure 4:
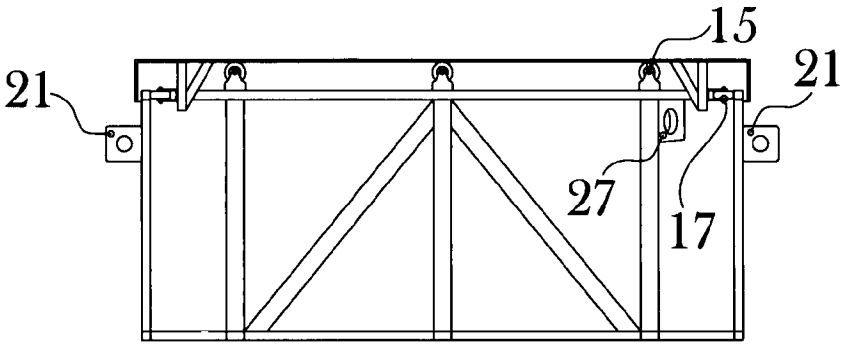
FIG. 4 is a side elevation view showing the two different sets of casters.

FIG. 4 shows by illustration a side elevation the two different sets of spaced-apart casters, 15 and 17, external lifting eyes 21, inner lifting eye 27, and horizontal caster 17.

Figure 6:
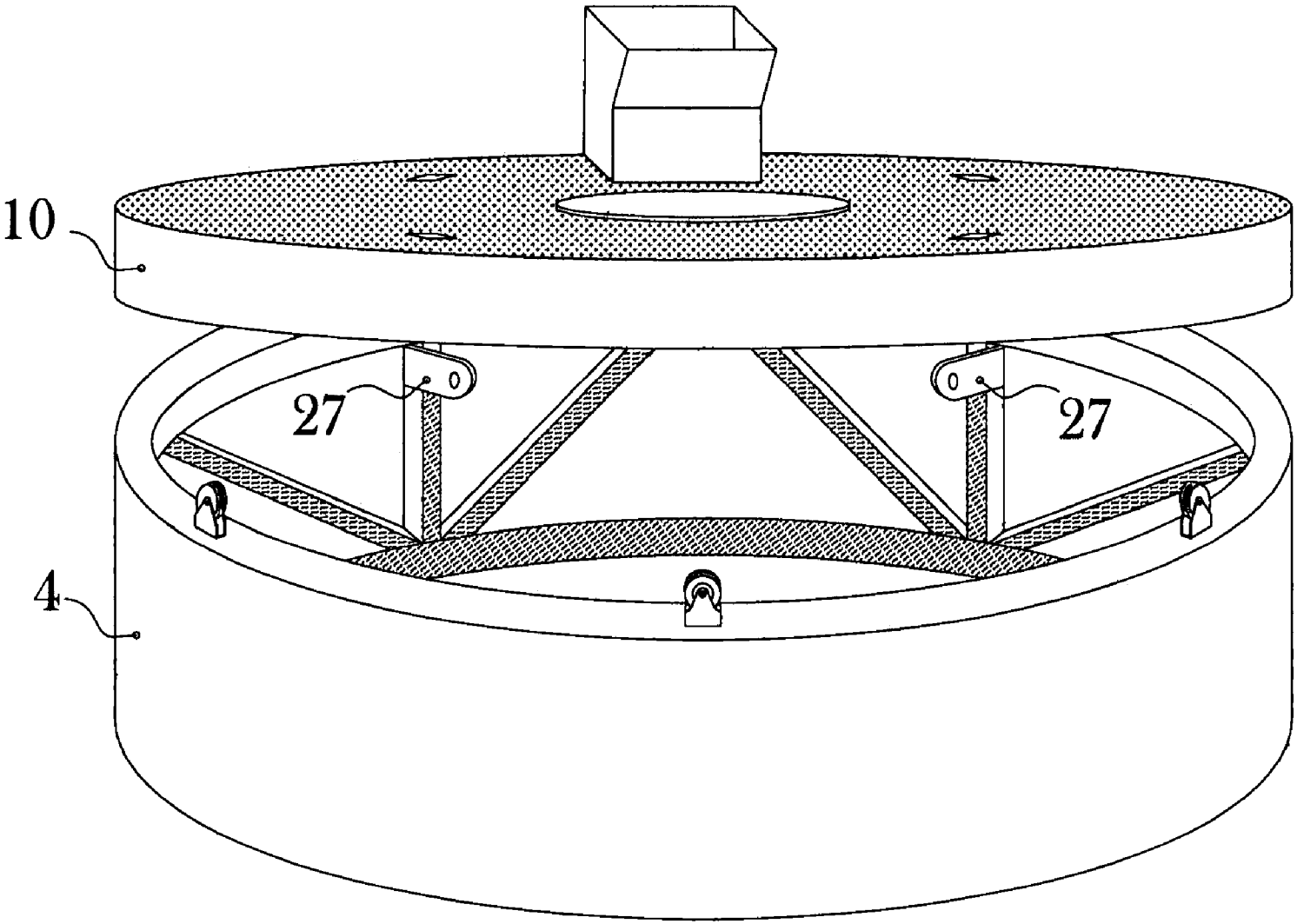
FIG. 6 is a perspective view showing the feed apparatus of the present invention with the rotatable tabletop partially lifted, showing the spaced-apart casters mounted on the lip on the top end of the cover and the rolled angle iron skeleton or framework that supports the cover's side wall.

FIG. 6 is a perspective view of the feed apparatus of the present invention (with rotatable tabletop 10 partially removed) showing by way of illustration the interior of cover 4 and inner lifting eyes 27. Also shown is the angle iron construction of skeleton or framework to which cover 4 is attached.

Figure 7:
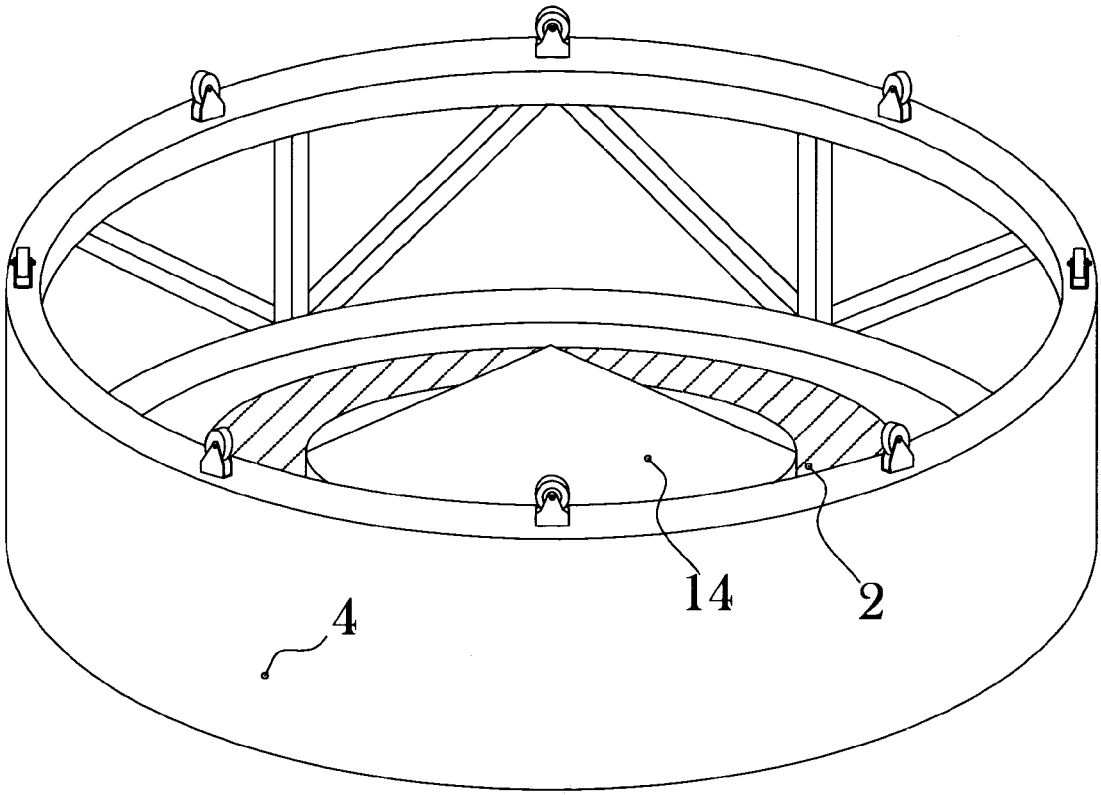
FIG. 7 is a perspective view of the feed apparatus of the present invention showing the interior of the cover and the form top in place on top of the furnace form to facilitate delivery of particulate material into annulus made by the furnace form and the furnace exterior wall.

FIG. 7 is a perspective view of the feed apparatus of the present invention showing the interior of cover 4 and form top 14 which would be placed on top of the furnace form to facilitate delivery of particulate material into annulus 2.

Figure 8:
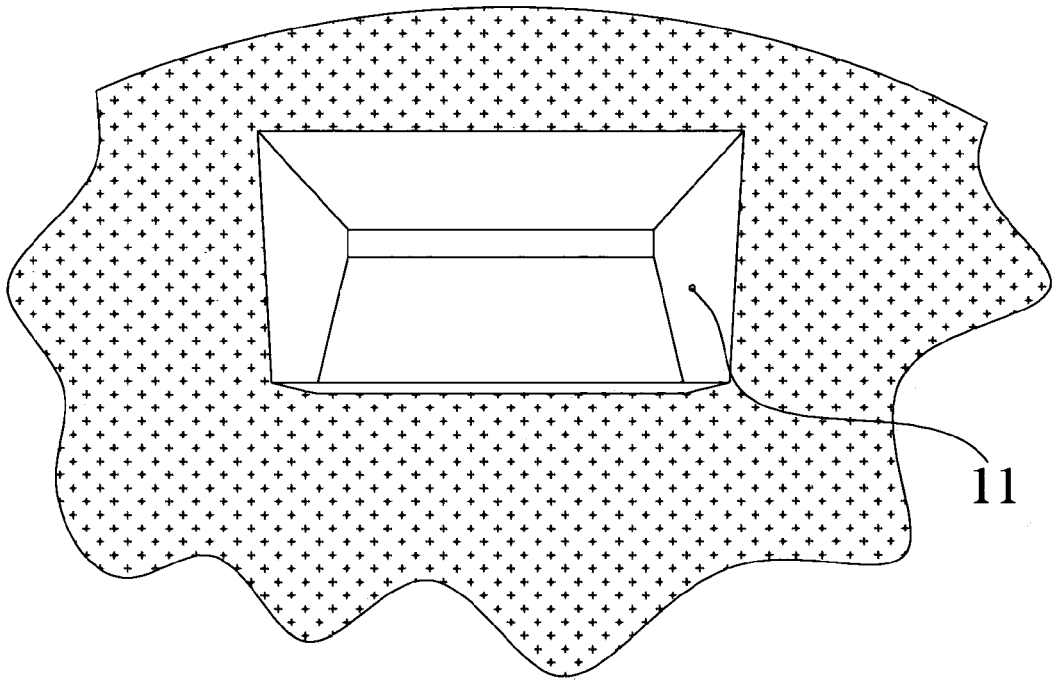
FIG. 8 is a top perspective view of the feed apparatus of the present invention showing the material spout for delivery of the particulate material into the interior of the cover.

FIG. 8 is a top perspective view of the feed apparatus of the present invention showing the material spout 11 for delivery of the particulate material into the interior of cover 4.

Figure 9:
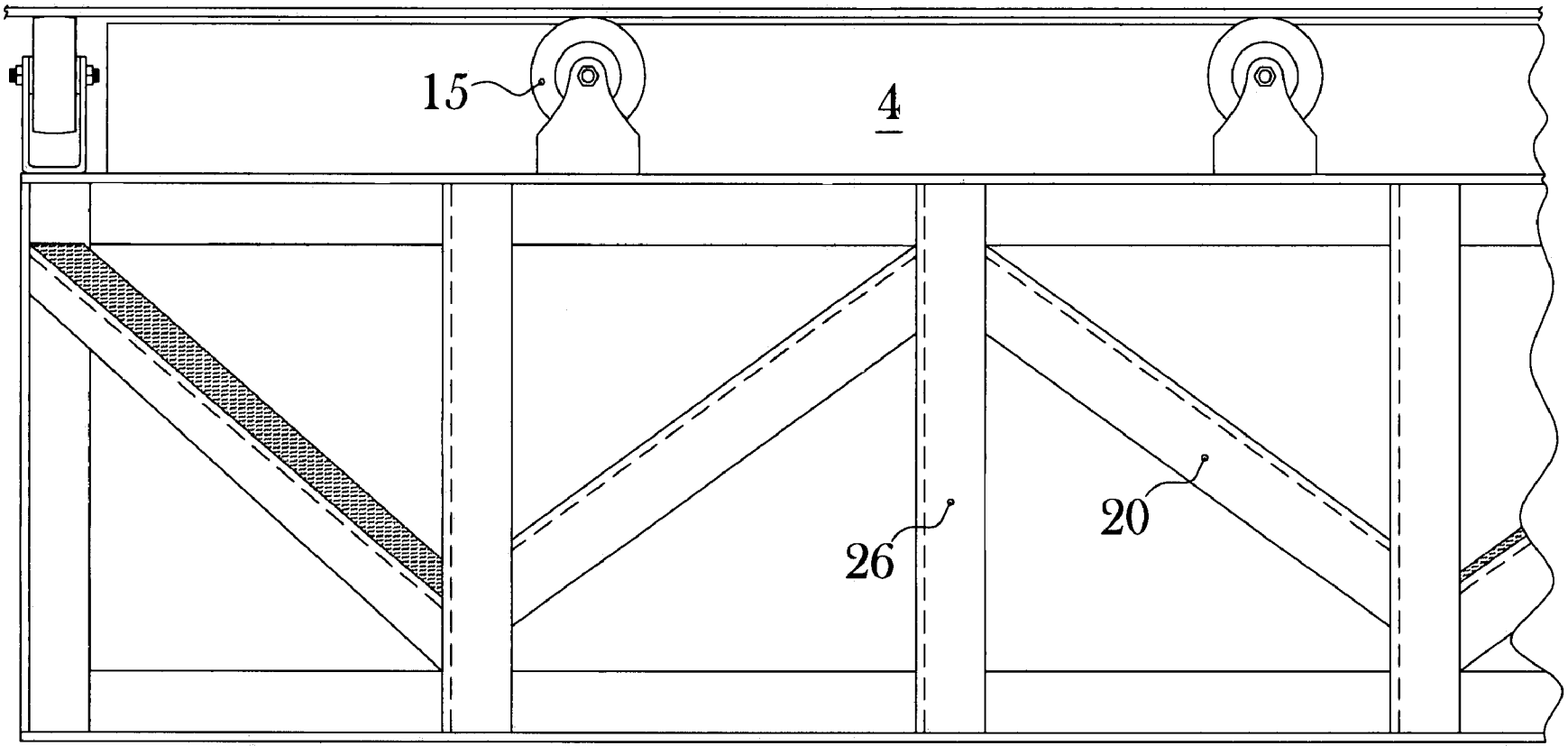
FIG. 9 is a side elevation view of the feed apparatus of the present invention showing the cover with the outer steel covering removed to show the top and bottom rings, vertical and diagonal angle iron construction for the framework or skeleton.

FIG. 9 is a side elevation view of the feed apparatus of the present invention showing cover 4 with the outer steel covering removed to show the top and bottom rings, vertical 26 and diagonal 20 angle iron construction for the skeleton or framework and vertical caster 15.

Figure 10:
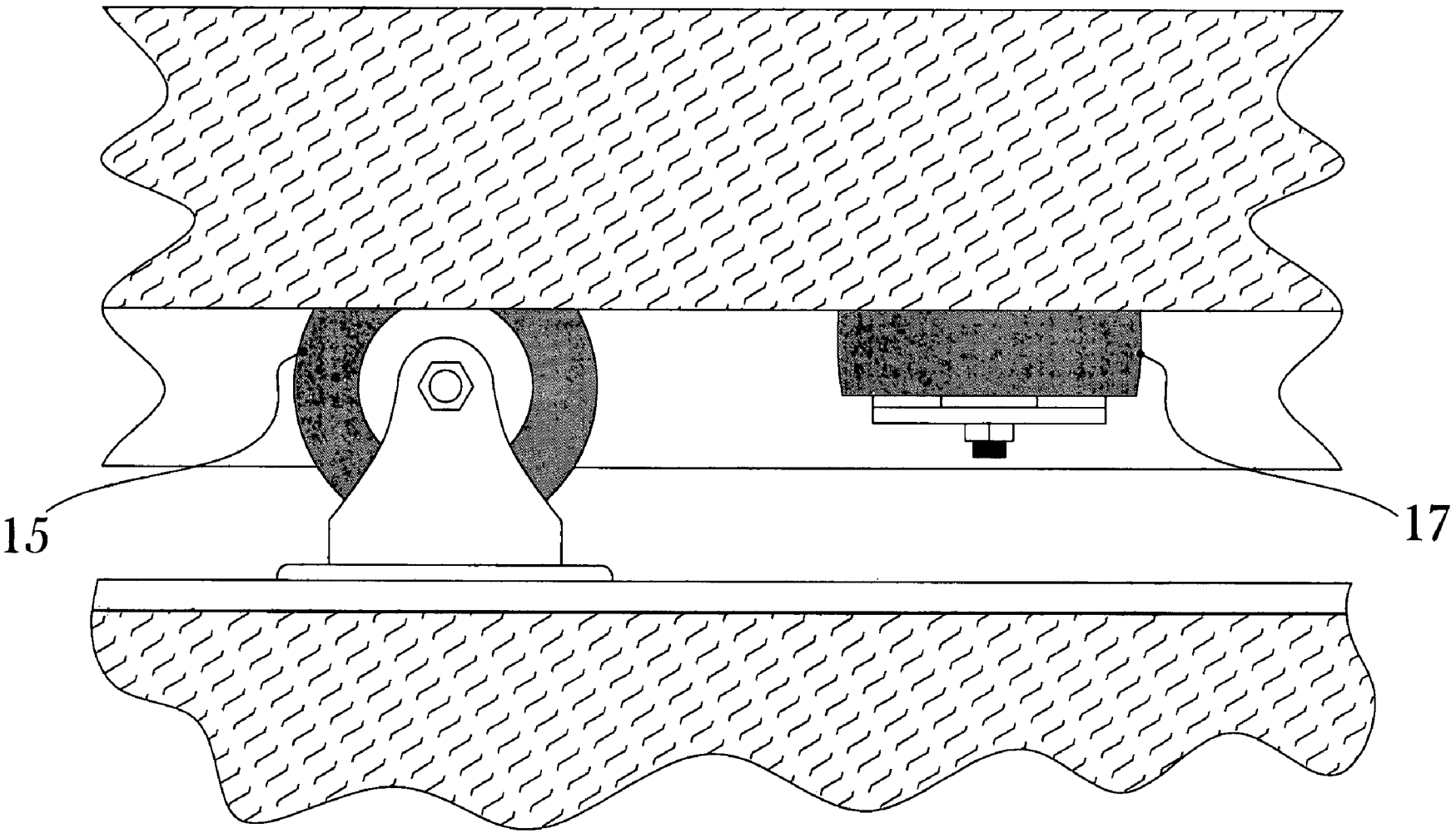
FIG. 10 is a side elevation view of the feed apparatus of the present invention showing the cover slightly raised to show the each of two casters in 90° relationship to each other.

FIG. 10 is a side elevation view of the feed apparatus of the present invention showing cover 4 slightly raised to show the casters 15 and 17 in 90° relationship to each other.

Figure 11:
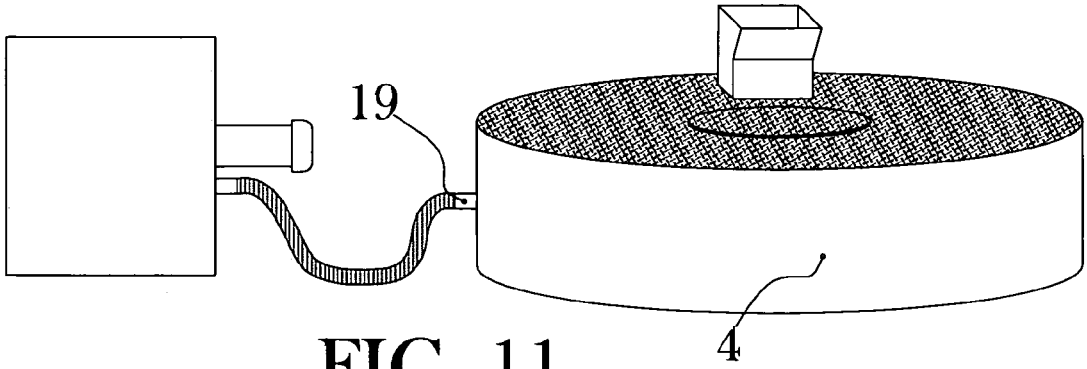
FIG. 11 is a perspective view of the portable dust collector of the present invention showing the cover with tabletop, vacuum means having one end connected to the side wall of the cover and the other end attached to a filter and collector apparatus for removal of dust and particulate materials that are generated in the re-lining of a coreless electric furnace.
Figure 12:
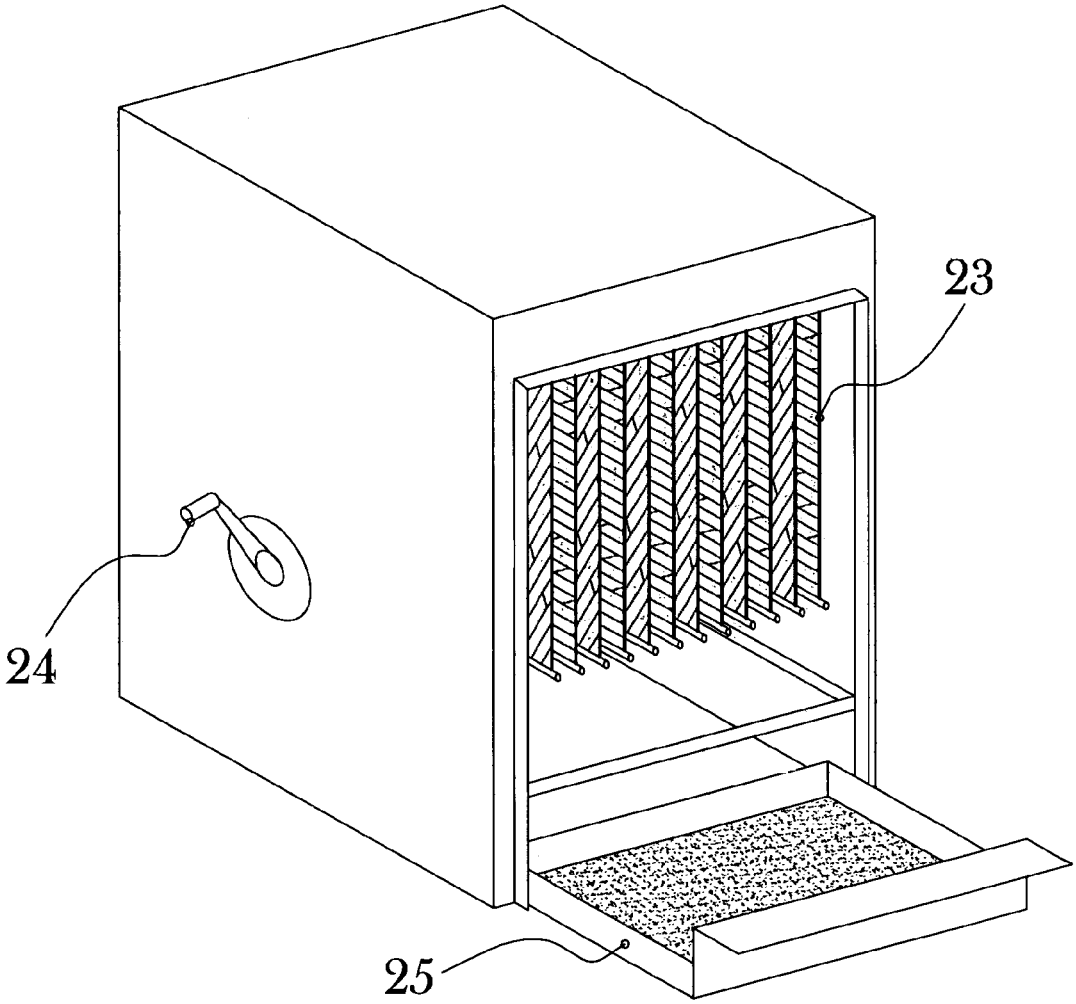
FIG. 12 is an isometric view of the portable dust collector of the present invention showing the filter and collector apparatus for filtering out dust and particulate materials that are generated

FIG. 11 is a perspective view of the portable dust collector of the present invention showing vacuum system connected via outlet pipe 19 to cover 4.

FIG. 12 is an isometric view of the vacuum and filtering system of the portable dust collector of the present invention with the front panel removed showing the rows of filter media 23, external crankshaft 24 for shaking the rows of filter media to remove buildup of silica dust and particulates, and catch pan 25 which is partially pulled out showing silica dust and particulates removed from a coreless furnace re-lining operations.

It is to be understood that the invention is not limited to the details give as described above but that it may be modified within the scope of the appended claims.

Having thus described the aforementioned invention, I claim:

1. A feed apparatus for delivering particulate material to a foundry furnace having a furnace form disposed within said furnace, said furnace form defining an annulus with the furnace exterior wall for receipt of said particulate material comprising:

a) a cover having a top end, a bottom end and a side wall, said bottom end adapted to fit on top of said furnace ring or melt deck floor and forming an airtight connection therewith;

b) a rotatable tabletop that is adapted to fit on top of said top end of said cover, said tabletop having at least one access port for delivering said particulate material into the interior of said cover;

c) a form top that is adapted to fit within said cover at said bottom end of said cover and on top of said furnace form to facilitate delivery of said particulate material into said annulus made by said furnace form and said furnace exterior wall;

d) means for rotating said tabletop about the centerline of said cover; and e) means for centering said tabletop as it rotates about the centerline of said cover.

2. The feed apparatus as set forth in claim 1 wherein said cover includes a cylindrical tank having a top end, a bottom end and side wall, said bottom end adapted to fit on top of a cylindrical furnace ring or melt deck and forming an airtight connection therewith.

3. The feed apparatus as set forth in claim 2 wherein said cylindrical tank has a rotatable tabletop that is adapted to fit on top of said top end of said cylindrical tank, said rotatable tabletop having at least one access port for delivering said particulate material into the interior of said cylindrical tank.

4. The feed apparatus as set forth in claim 3 wherein said cylindrical tank has a cylindrical form top of a generally upwardly tapered conical shape that is adapted to fit within said cylindrical tank at said bottom end of said cylindrical tank and on top of said furnace form to facilitate delivery of said particulate material into said annulus made by said furnace form and said furnace ring.

5. The feed apparatus as set forth in claim 2 wherein said cylindrical tank includes means for rotating said tabletop about the centerline of said cylindrical tank.

6. The feed apparatus as set forth in claim 5 wherein said means for rotating said tabletop about the centerline of said cylindrical tank includes a plurality of spaced-apart casters which are mounted on the top lip of said cylindrical tank in engagement with the underside of said tabletop, said spaced-apart casters providing an air gap between the underside of said tabletop and the top lip of said cylindrical tank for the ingress of air into said cylindrical tank.

7. The feed apparatus as set forth in claim 2 wherein said plurality of space-apart casters includes eight individual casters.

8. The feed apparatus of claim 3 wherein at least one access port includes a central port disposed in said tabletop for facilitating delivery of said particulate materials into the interior of said cover.

9. The feed apparatus as set forth in claim 2 wherein said means for centering said tabletop as it rotates about the centerline of said cylindrical tank includes a plurality of spaced-apart casters which are individually mounted to corresponding gussets that are rigidly mounted to the underside of said tabletop.

10. The feed apparatus as set forth in claim 9 wherein said plurality of space-apart casters for centering said tabletop as it rotates about the centerline of said cylindrical tank include eight individual casters.

11. The feed apparatus as set forth in claim 3 wherein said rotatable tabletop comprising further a flanged port concentric with the centerline of said rotatable tabletop for facilitating delivery of said particulate material into said annulus made by said furnace form and said furnace exterior wall.

12. A portable dust collector for filtering and removing dust and particulate materials that are generated in a foundry furnace operation having a furnace form disposed within said furnace, said furnace form defining an annulus with a furnace ring or melt deck floor generated in industrial plants comprising:

a) a cover having a top end, a bottom end and a side wall, said bottom end adapted to fit on top of said furnace ring or melt deck floor and forming an airtight connection therewith;

b) a rotatable tabletop that that is adapted to fit on top of said top end of said cover, said tabletop having at least one access port for delivering said particulate material into the interior of said cover;

c) a form top that is adapted to fit within said cover at said bottom end of said cover and on top of said furnace form to facilitate delivery of said particulate material into said annulus made by said furnace form and said furnace ring or melt deck floor;

d) means for rotating said tabletop about the centerline of said cover;

e) means for centering said tabletop as it rotates about the centerline of said cover; and f) means for filtering said dust and particulate materials that are generated within said cover during plant operations and collecting same for ultimate removal and disposition thereof.

13. The portable dust collector as set forth in claim 12 wherein said means for filtering said dust and particulate materials includes a vacuum system that is attached to the cover and causes a negative air pressure in said furnace, said vacuum system being in communication with a dust collector and filter system for collection and removal of generated dust and particulate material generated in said furnace.

14. The portable dust collector as set forth in claim 12 wherein said cover includes a cylindrical tank having a top end, a bottom end and side wall, said bottom end adapted to fit on top of a cylindrical furnace ring and forming an airtight connection therewith.

15. The portable dust collector as set forth in claim 14 wherein said cylindrical tank has a rotatable tabletop that is adapted to fit on top of said top end of said cylindrical tank, said rotatable tabletop having at least one access port for delivering said particulate material into the interior of said cylindrical tank.

16. The portable dust collector as set forth in claim 15 wherein said cylindrical tank has a cylindrical form top of a generally upwardly tapered conical shape that is adapted to fit within said cylindrical tank at bottom second end of said cylindrical tank and on top of said furnace form to facilitate delivery of said particulate material into said annulus made by said furnace form and said furnace exterior wall.

17. The portable dust collector as set forth in claim 14 wherein said cylindrical tank includes means for rotating said tabletop about the centerline of said cylindrical tank.

18. The portable dust collector as set forth in claim 17 wherein said means for rotating said tabletop about the centerline of said cylindrical tank includes a plurality of spaced-apart casters which are mounted on the top lip of said cylindrical tank in engagement with the underside of said tabletop, said spaced-apart casters providing an air gap between the underside of said tabletop and the top lip of said cylindrical tank for the ingress of air into said cylindrical tank.

19. The portable dust collector as set forth in claim 14 wherein said plurality of space-apart casters includes eight individual casters.

20. The portable dust collector as set forth in claim 14 wherein said means for centering said tabletop as it rotates about the centerline of said cylindrical tank includes a plurality of spaced-apart casters which are individually mounted to corresponding gussets that are rigidly mounted to the underside of said tabletop.

21. The portable dust collector as set forth in claim 20 wherein said plurality of space-apart casters for centering said tabletop as it rotates about the centerline of said cylindrical tank include eight individual casters.

22. The portable dust collector as set forth in claim 15 wherein said rotatable tabletop comprising further a flanged port concentric with the centerline of said rotatable tabletop for facilitating delivery of said particulate material into said annulus made by said furnace form and said furnace exterior wall.

23. The portable dust collector as set forth in claim 13 wherein said filtering and collection means includes a filter media for entraining said dust and particulate material.

24. The portable dust collector as set forth in claim 13 further comprising a means for wetting the filter cake to turn the dust and particulate material into mud for safe handling and disposal.

25. The portable dust collector as set forth in claim 13 wherein said vacuum pulls about 1250 cubic feet per minute (cfm) and said ingress of air through said air gap permits air inflow of about 320 cubic feet per minute (cfm) thereby maintaining a negative air pressure in said furnace.

* * * * *